US009709324B1

(12) United States Patent
Yao et al.

(10) Patent No.: US 9,709,324 B1
(45) Date of Patent: Jul. 18, 2017

(54) LIQUID COOLING WITH PARASITIC PHASE-CHANGE PUMPS

(71) Applicant: Rockwell Collins, Inc., Cedar Rapids, IA (US)

(72) Inventors: Qizhou Matthew Yao, Coralville, IA (US); Ryan J. Legge, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 263 days.

(21) Appl. No.: 13/672,916

(22) Filed: Nov. 9, 2012

(51) Int. Cl.
*F25B 1/00* (2006.01)
*F25D 31/00* (2006.01)
*F25B 39/02* (2006.01)
*F25B 39/04* (2006.01)

(52) U.S. Cl.
CPC ..... *F25D 31/00* (2013.01); *F25B 39/02* (2013.01); *F25B 39/04* (2013.01)

(58) Field of Classification Search
CPC ..... H05K 7/20309; H05K 7/20318; F25B 39/02; F25B 23/006
USPC ..... 62/118, 119, 259.2, 515; 310/306
See application file for complete search history.

(56) References Cited

U.S. PATENT DOCUMENTS 5,445,213 A * 8/1995 Im ..... F25D 16/00 165/10
6,437,981 B1 * 8/2002 Newton et al. ..... 361/700
6,526,776 B2 * 3/2003 Patzner ..... F16L 37/36 62/101
6,550,530 B1 * 4/2003 Bilski ..... 165/104.26
6,591,625 B1 * 7/2003 Simon ..... 62/259.2
6,658,861 B1 * 12/2003 Ghoshal et al. ..... 62/3.7
6,741,469 B1 * 5/2004 Monfarad ..... H01L 23/427 165/104.26
6,834,671 B2 * 12/2004 Cotte ..... F15C 5/00 137/496
6,834,971 B2 * 12/2004 Rash ..... G02B 5/005 359/227
6,845,625 B1 * 1/2005 Pokharna ..... 62/118
6,976,527 B2 * 12/2005 Kirshberg ..... B82Y 30/00 165/104.26
6,994,151 B2 * 2/2006 Zhou et al. ..... 165/80.4
7,000,684 B2 * 2/2006 Kenny et al. ..... 165/80.4
(Continued)

*Primary Examiner* — Ljiljana Ciric
*Assistant Examiner* — Kirstin Oswald
(74) *Attorney, Agent, or Firm* — Angel N. Gerdzhikov; Donna P. Suchy; Daniel M. Barbieri

(57) ABSTRACT

A heat transferring method and system utilizing a parasitic phase-change pump is disclosed. The parasitic phase-change pump is utilized to circulate a working fluid. The method may include: facilitating heat transfer from at least one evaporator to a condenser via the working fluid; receiving and containing the working fluid from the condenser utilizing an expandable MEMS device; controlling and regulating the flow of the working fluid from the expandable MEMS device towards the at least one evaporator utilizing at least one MEMS based directional device, wherein the working fluid flowing from the expandable MEMS device towards at least one evaporator is in liquid phase; and utilizing the working fluid flowing from the expandable MEMS device towards at least one evaporator to facilitate heat transfer for at least one target device located between at least one evaporator and the condenser or between the expandable MEMS device and the evaporator.

18 Claims, 3 Drawing Sheets

(56) References Cited

U.S. PATENT DOCUMENTS

| | | | | |
|---|---|---|---|---|
| 7,021,369 | B2 * | 4/2006 | Werner et al. | 165/104.33 |
| 7,104,312 | B2 * | 9/2006 | Goodson et al. | 165/80.4 |
| 7,334,630 | B2 * | 2/2008 | Goodson et al. | 165/104.33 |
| 7,723,760 | B2 * | 5/2010 | Henderson et al. | 257/276 |
| 9,179,575 | B1 * | 11/2015 | Yao | H01L 23/427 |
| 2003/0004657 | A1 * | 1/2003 | Allen | G06F 3/016 702/45 |
| 2003/0061824 | A1 * | 4/2003 | Marsala | 62/119 |
| 2004/0093887 | A1 * | 5/2004 | Shyy et al. | 62/259.2 |
| 2004/0112585 | A1 * | 6/2004 | Goodson et al. | 165/299 |
| 2005/0067146 | A1 * | 3/2005 | Thayer et al. | 165/80.3 |
| 2005/0144968 | A1 * | 7/2005 | Shakespeare | 62/298 |
| 2006/0065386 | A1 * | 3/2006 | Alam | G06F 1/20 165/104.33 |
| 2009/0284926 | A1 * | 11/2009 | Agostini | F28D 15/0266 361/700 |

* cited by examiner

LIQUID COOLING WITH PARASITIC PHASE-CHANGE PUMPS

TECHNICAL FIELD

The present disclosure relates generally to heat transfer systems, and more particularly to liquid based heat transfer systems.

BACKGROUND

Liquid cooling is a method of heat transfer/removal from components. As opposed to air cooling, liquid is used as the heat transport medium. Liquid cooling can be used to cool many electrical devices such as a computer's central processing unit (CPU) or the like. Cooling electrical devices continues to challenge manufactures as the size of these devices continue to get smaller and the functionality of these devices continues to increase. All this is required in the smallest space possible, which is difficult to achieve using existing heat transfer technologies. Furthermore, a conventional liquid cooling system includes a pump to circulate the liquid. Pumps utilized in such systems actively consume energy to operate properly, therefore require additional cost, volume, and energy consumption. Mechanical pumps are also subject to reliability issues and would fail from time to time.

Therein lies a need for a method and system for providing liquid cooling without the aforementioned shortcomings.

SUMMARY

The present disclosure is directed to a heat transferring system. The system may include an evaporator and a condenser configured for receiving heat transfer from the evaporator via a working fluid. The system further includes an expandable micro-electromechanical systems (MEMS) device configured for receiving and containing the working fluid from the condenser. One or more MEMS based directional device is utilized to control and regulate the flow of the working fluid from the expandable MEMS device towards the evaporator. The working fluid flowing from the expandable MEMS device towards the evaporator is in liquid phase and is utilized to facilitate heat transfer for at least one target device.

Another embodiment of the present disclosure is directed to a heat transferring method. The method may include: facilitating heat transfer from at least one evaporator to a condenser via a working fluid; receiving and containing the working fluid from the condenser utilizing an expandable MEMS device; controlling and regulating the flow of the working fluid from the expandable MEMS device towards the at least one evaporator utilizing at least one MEMS based directional device, wherein the working fluid flowing from the expandable MEMS device towards the at least one evaporator is in liquid phase; and utilizing the working fluid flowing from the expandable MEMS device towards at least one evaporator to facilitate heat transfer for at least one target device.

A further embodiment of the present disclosure is directed to a heat transferring system. The system may include at least one evaporator and a condenser configured for receiving heat transfer from at least one evaporator via a working fluid. The system may further include an expandable MEMS device configured for receiving and containing the working fluid from the condenser. One or more MEMS based directional device is utilized to control and regulate the flow of the working fluid from the expandable MEMS device towards the evaporator. The working fluid flowing from the at least one evaporator towards the condenser is in vapor phase and the working fluid flowing from the expandable MEMS device towards the evaporator is in liquid phase. The flowing working fluid is utilized to facilitate heat transfer for at least one target device located between the condenser and the expandable MEMS device or between the expandable MEMS device and the evaporator.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to exemplary embodiments of the disclosure, examples of which are illustrated in the accompanying drawings.

The present disclosure is directed to a method and system for providing liquid based heat transfer for electrical devices. In accordance with the present disclosure, a parasitic phase-change pump is utilized to circulate the liquid. The parasitic phase-change pump uses energy harvested directly from waste heat to move the cooling liquid passively. Liquid cooling with parasitic phase-change pumps simultaneously serves two purposes: 1) harvesting heat which would be wasted otherwise; and 2) driving cooling liquid through one or more target devices (devices that are intended to be cooled). The liquid cooling system in accordance with the present disclosure eliminates the need for a mechanical liquid pump, further reducing its energy and volume consumption.

Figure 1:
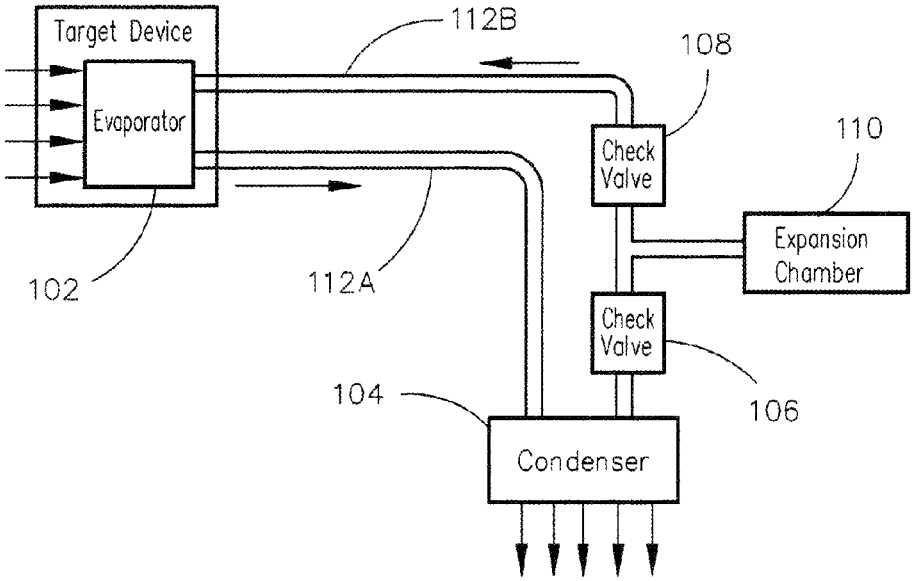
FIG. 1 is a block diagram illustrating a liquid cooling system using a Phase-Change Autonomous Transport of Heat (PATH) process.

Referring to FIG. 1, a block diagram depicting a liquid cooling system 100 using a Phase-Change Autonomous Transport of Heat (PATH) process is shown. The PATH process is disclosed in U.S. patent application Ser. No. 13/418,710 filed on Mar. 12, 2012 and entitled "MEMS Based Device for Phase-Change Autonomous Transport of Heat (PATH)," which is incorporated herein by reference.

The PATH process utilizes a micro-electromechanical systems (MEMS) based cooling system made from a combination of evaporator 102, condenser 104, MEMS check valves 106 and 108, MEMS expansion chamber 110, phase-change fluid, and flexible tubings 112A and 112B. While idle, the system is completely filled with a phase-change fluid and the expansion chamber 110 remains uncharged. The evaporator 102 is in direct contact with a device that is intended to be cooled (may be referred to as a target device). Operation of the MEMS-based cooling system starts automatically when the temperature of the target device reaches the boiling point of the phase-change fluid inside the evaporator. The system operates periodically in the following two sequential and repeating states, the vapor transfer state, and the condensate return state.

More specifically, when the liquid in the evaporator 102 reaches the boiling point, saturated vapor start to move toward the condenser 104 where vapor is condensed back to liquid. Initially, the evaporation rate is greater than condensation rate, resulting in the continuous increase of the system pressure. As the liquid inside the evaporator 102 continues to evaporate, condensed liquid coming out of the condenser 104 is pushed pass the first MEMS check valve 106 into the MEMS expansion chamber 110. As the liquid in the evaporator 102 starts to dry out, the rate of condensation exceeds the rate of evaporation, resulting in the decrease of the pressure inside the evaporator 102 while the pressure at the expansion chamber 110 remains roughly at the expanded system pressure. When the pressure difference between the evaporator 102 and expansion chamber 110 reaches the crack pressure of the second MEMS check valve 108, liquid automatically flows through the second check valve 108 and into the evaporator 102, and a new operating cycle begins.

It is noticed that the PATH process as described above enables passive heat transfer from the evaporator 102 to the condenser 104. In addition, the PATH process provides the same function as a pump, circulating fluid within the loop. The PATH process may therefore be utilized to function as a parasitic pump to facilitate single-phase liquid cooling. That is, the present disclosure utilizes the parasitic phase-change pump to move single-phase liquid through hot devices for their cooling needs.

Figure 2:
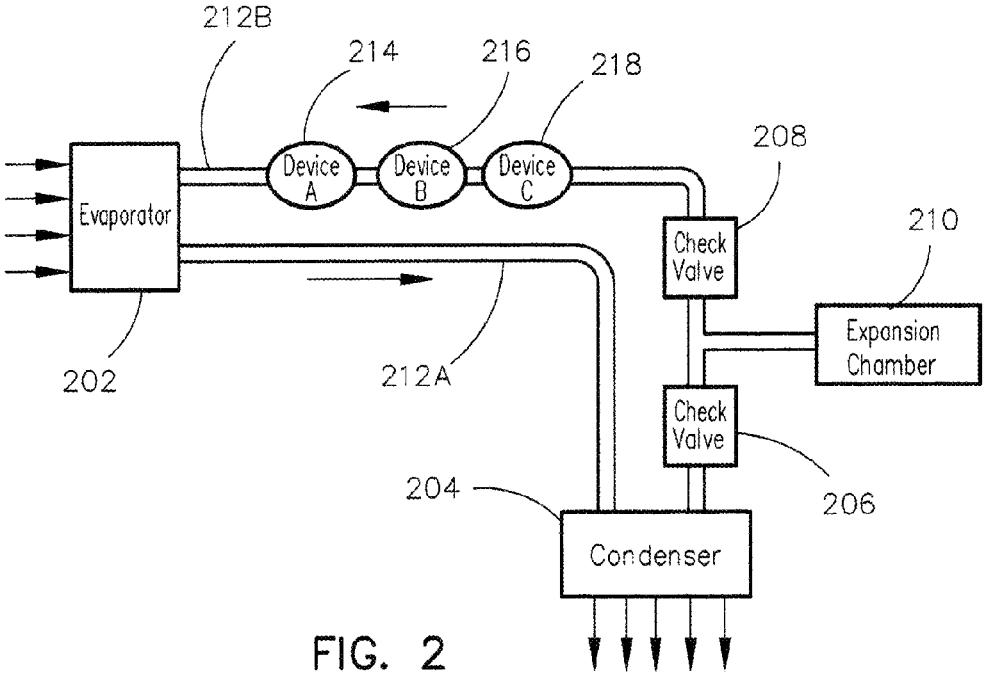
FIG. 2 is a block diagram illustrating a liquid cooling system with a parasitic phase-change pump in accordance with the present disclosure.

Referring to FIG. 2, a block diagram depicting a liquid cooling system 200 with a parasitic phase-change pump in accordance with the present disclosure is shown. Unlike the PATH process described above, the evaporator 202 in accordance with the present disclosure is not directly attached to a target device that the system 200 intends to cool. Instead, the evaporator 202 may be placed at any location suitable for harvesting heat from its environment. For instance, the evaporator 202 may be placed near an exhaust pipe/vent, and when the heat harvested by the evaporator 202 reaches the boiling point of the phase-change fluid inside the evaporator, the flow of the vapor starts automatically as described above.

More specifically, when the liquid in the evaporator 202 reaches the boiling point, saturated vapor start to move through tube 212A toward the condenser 204 where vapor is condensed back to liquid. As the liquid inside the evaporator 202 continues to evaporate, condensed liquid coming out of the condenser 204 is pushed through the first MEMS check valve 206 into the MEMS expansion chamber 210. When the pressure difference between the evaporator 202 and expansion chamber 210 reaches the crack pressure of the second MEMS check valve 208, liquid automatically flows through the second check valve 208 and through tubing 2128 towards the evaporator 202.

As depicted in FIG. 2, one or more target devices 214 through 218 (i.e., the devices intended to be cooled) are placed between the second check valve 208 and the evaporator 202. The condensed liquid flowing from the second check valve 208 towards the evaporator 202 is therefore used to cool the target devices 214 through 218. The condensed liquid, flown through the target devices 214 through 218, is then received at the evaporator 202 and completes a cycle. In this manner, the evaporator 202 and the condenser 204 jointly function as a parasitic pump to circulate liquid through the target devices for cooling purposes.

It is contemplated that the distances between the evaporator 202 and the target devices 214, 216 and 218 are arbitrary and may be determined by various design factors without departing from the spirit and scope of the present disclosure. Due to the cyclic fluid motion in the system 200, condensed liquid flowing through the target devices 214, 216 and 218 is also cyclic, which may result in temperature fluctuation within such devices if they have constant heat dissipation. However, this system behavior may be designed in such a way that the fluid cycle is frequent enough that periodic pause of the liquid motion would not cause significant temperature rise. If devices 214, 216 and 218 also operate in a cyclic manner, the system behavior may be designed such that the fluid cycle matches the operating cycle of such devices, ensuring cooling liquid flows through the devices only when the devices are operating and generating heat.

It is also contemplated that while three target devices are depicted in the figure, the number of target devices may vary without departing from the spirit and scope of the present disclosure. It is understood, however, when more than one target devices need to be cooled, the devices are required to form a serial connection that allows the condensed liquid to flow through sequentially. In addition, the order of the devices can be placed from lowest to highest allowable operating temperature, ensuring that devices with low operating temperature are cooled first.

Figure 3:
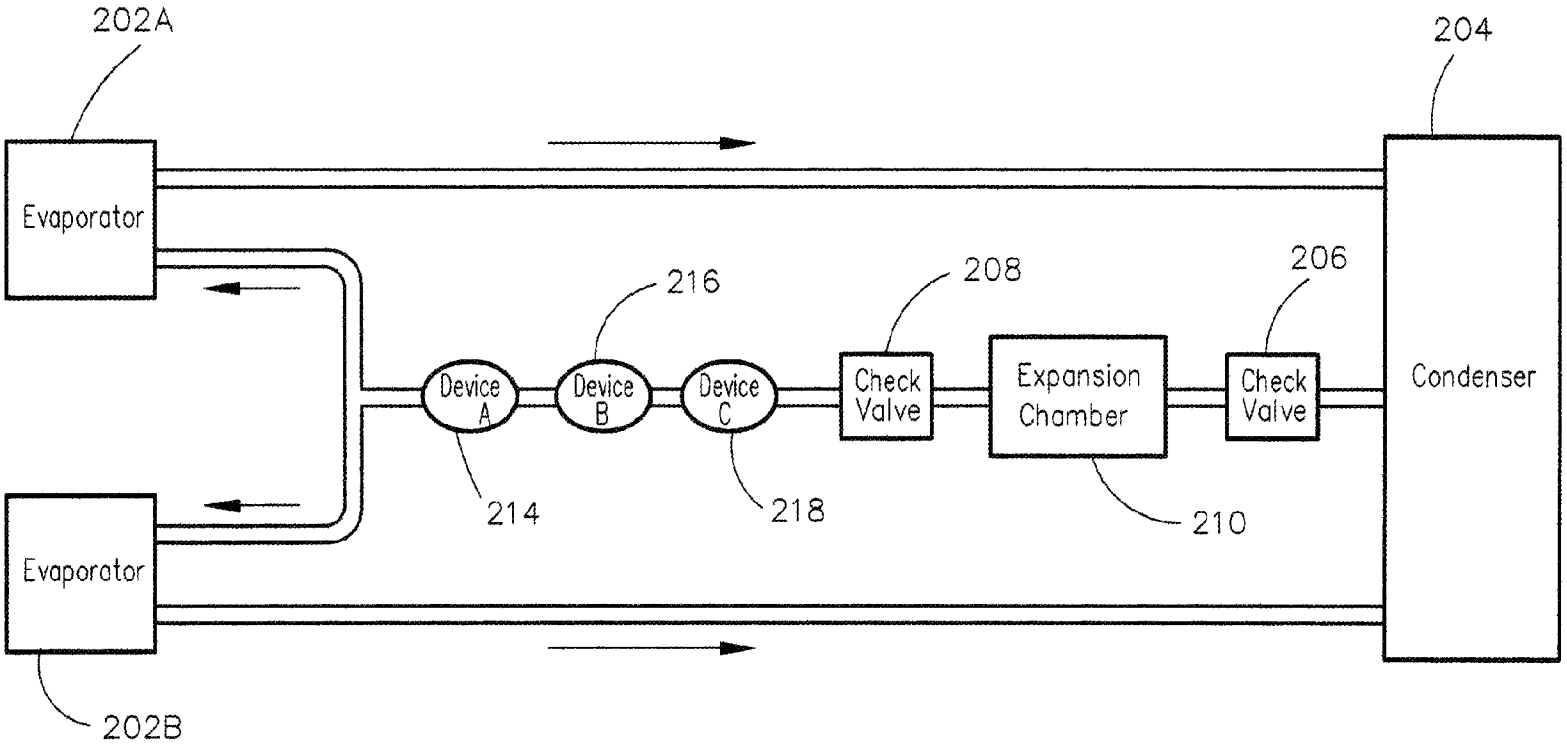
FIG. 3 is a block diagram illustrating a liquid cooling system with a parasitic phase-change pump in accordance with the present disclosure, wherein the parasitic phase-change pump includes more than one evaporator.

It is further contemplated that more than one evaporator may be utilized to harvest heat from the environment. For instance, as shown in FIG. 3, two evaporators, 202A and 202B, may work in parallel. Such a configuration allows the liquid cooling system to harvest heat from more than one location, which may be beneficial in certain working environments.

It is understood that utilizing flexible tubing to connect the various components of the cooling system allows the various components to be located apart from each other. This is appreciated in various working environment because the device intended to be cooled may have very limited space around it, and therefore difficult to fit other types of cooling mechanisms into the limited space. The ability to position the various components of the cooling system apart from each other also allows a designer to take advantage of any available space inside a design, as the cooling system in accordance with the present disclosure no longer requires a dedicated space to operate.

Furthermore, it is contemplated that since the system in accordance with the present disclosure is a heat transfer system, it can be used alternatively for heating and/or cooling as is required. It is also possible to place certain target devices in the vapor route (i.e., the route from the evaporator to the condenser). The specific placement of the target device(s) may be determined based on its heating/cooling needs, as well as other design factors such as operating temperature, space availabilities or the like.

It is understood that the phase-change fluid utilized in the system can be, without limitation, any working fluids include but are not limited to water, ethanol, methanol, acetone, as well as other engineered heat transfer fluids or any combination therein. Other working fluids having even better heat transfer characteristics may also be used.

Figure 4:
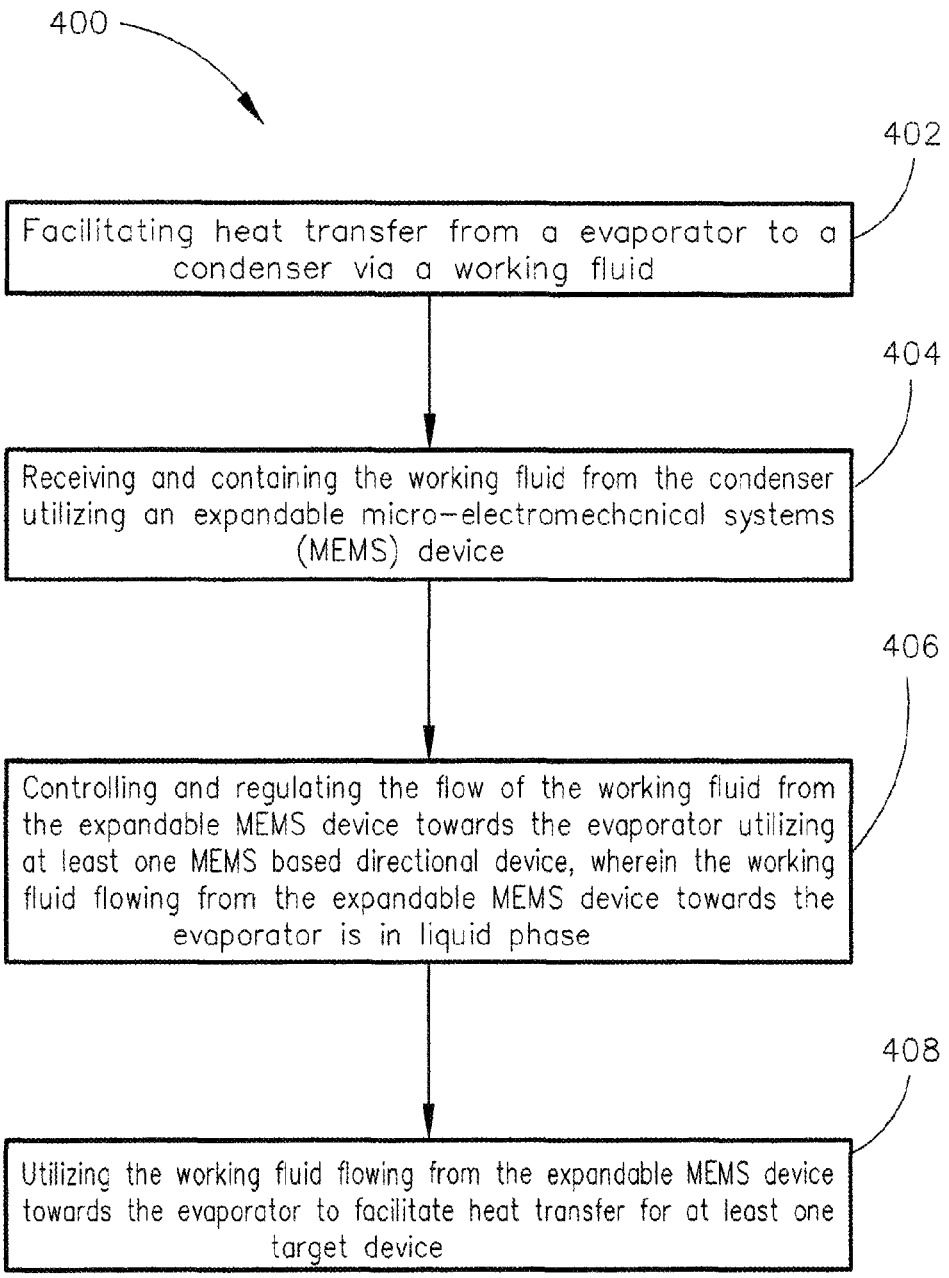
FIG. 4 is a method flow diagram illustrating a heat transferring method in accordance with the present disclosure.

FIG. 4 is a method flow diagram illustrating a heat transferring method 400 in accordance with the present disclosure. In one embodiment, step 402 facilitates heat transfer from an evaporator to a condenser via a working fluid. Step 404 receives and contains the working fluid from the condenser utilizing an expandable MEMS device (e.g., MEMS expansion chamber). Step 406 controls and regulates the flow of the working fluid from the expandable MEMS device towards the evaporator utilizing at least one MEMS based directional device (e.g., MEMS check valves). Step 408 utilizes the working fluid flowing from the expandable MEMS device towards the evaporator to facilitate heat transfer for at least one target device.

It is understood that the present disclosure is not limited to any underlying implementing technology. The present disclosure may be implemented using a variety of technologies without departing from the scope and spirit of the disclosure or without sacrificing all of its material advantages. It is also understood that the expandable MEMS device and the at least one MEMS based directional device may be integrated into a single MEMS device, therefore they may be one and the same.

It is understood that the specific order or hierarchy of steps in the processes disclosed is an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

It is believed that the present disclosure and many of its attendant advantages will be understood by the foregoing description, and it will be apparent that various changes may be made in the form, construction, and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. A heat transferring system, comprising:

an evaporator;

a condenser in direct fluid connection with the evaporator and configured for receiving heat transfer from the evaporator via a working fluid;

an expandable micro-electromechanical systems (MEMS) device configured for receiving and containing the working fluid from the condenser;

at least one MEMS based check valve configured for controlling and regulating the flow of the working fluid from the expandable MEMS device towards the evaporator; and at least one target device;

wherein the evaporator and the condenser jointly form a parasitic phase-change pump to circulate the working fluid based on pressure differences controlled and regulated by the at least one MEMS based check valve and the expandable MEMS device when the heat transferring system is in operation, and when a pressure difference between the evaporator and the expandable MEMS device reaches a crack pressure of the at least one MEMS based check valve, the working fluid flows from the expandable MEMS device towards the evaporator in liquid phase to facilitate heat transfer from the at least one target device, wherein the at least one target device is positioned on a path between the expandable MEMS device and the evaporator, and wherein the evaporator forms no direct contact with the at least one target device that requires heat transfer.

2. The heat transferring system of claim 1, wherein the working fluid changes phase from a liquid to a vapor in the evaporator and changes phase from a vapor to a liquid in the condenser.

3. The heat transferring system of claim 1, wherein said at least one MEMS based check valve includes a pair of MEMS based check valves configured for controlling and regulating the flow of the working fluid into and out of the expandable MEMS device, respectively.

4. The heat transferring system of claim 1, further comprising:

an additional evaporator configured for providing heat transfer from said additional evaporator to the condenser via the working fluid through a path different from the first mentioned evaporator.

5. The heat transferring system of claim 1, wherein flexible tubing are utilized for coupling the evaporator, the condenser, the expandable MEMS device, and the at least one MEMS based check valve.

6. The heat transferring system of claim 1 in which parts or the entire heat transferring system is incorporated into one or more integrated circuit chips.

7. A heat transferring method, comprising:

forming a parasitic phase-change pump to circulate a working fluid, further comprising the steps of:

facilitating heat transfer from at least one evaporator to a condenser via the working fluid;

receiving and containing the working fluid from the condenser utilizing an expandable micro-electromechanical systems (MEMS) device; and controlling and regulating the flow of the working fluid from the expandable MEMS device towards the at least one evaporator utilizing at least one MEMS based check valve, wherein when a pressure difference between the at least one evaporator and the expandable MEMS device reaches a crack pressure of the at least one MEMS based check valve, the working fluid flows from the expandable MEMS device towards the at least one evaporator in liquid phase; and providing heat transfer for at least one target device positioned on a path between the expandable MEMS device and the at least one evaporator utilizing the working fluid flowing from the expandable MEMS device towards the at least one evaporator, wherein the at least one evaporator forms no direct contact with the at least one target device that requires heat transfer.

8. The heat transferring method of claim 7, wherein the working fluid changes phase from a liquid to a vapor in the at least one evaporator and changes phase from a vapor to a liquid in the condenser.

9. The heat transferring method of claim 7, wherein said at least one MEMS based check valve includes a pair of MEMS based check valves configured for controlling and regulating the flow of the working fluid into and out of the expandable MEMS device, respectively.

10. The heat transferring method of claim 7, wherein the at least one evaporator includes a plurality of evaporators configured for providing heat transfer to the condenser via different paths.

11. The heat transferring system of claim 7, wherein flexible tubing are utilized for coupling the evaporator, the condenser, the expandable MEMS device, and at least one MEMS based check valve.

12. The heat transferring method of claim 7, wherein said heat transferring method is configured for facilitating heat transfer for one or more integrated circuit chips.

13. A heat transferring system, comprising:

a plurality of evaporators;

a condenser configured for receiving heat transfer from at least one of the plurality of evaporators via a working fluid;

an expandable micro-electromechanical systems (MEMS) device configured for receiving and containing the working fluid from the condenser;

at least one MEMS based check valve configured for controlling and regulating the flow of the working fluid from the expandable MEMS device towards the evaporator; and at least one target device;

wherein the at least one evaporator and the condenser jointly form a parasitic phase-change pump to circulate the working fluid based on pressure differences controlled and regulated by the at least one MEMS based check valve and the expandable MEMS device when the heat transferring system is in operation, wherein the working fluid flowing from the at least one evaporator towards the condenser is in vapor phase and when a pressure difference between the at least one evaporator and the expandable MEMS device reaches a crack pressure of the at least one MEMS based check valve, the working fluid flows from the expandable MEMS device towards the evaporator in liquid phase, and wherein the flowing working fluid is utilized to facilitate heat transfer from the at least one target device located between the at least one evaporator and the condenser or between the expandable MEMS device and the evaporator, wherein the plurality of the evaporators are configured for providing heat transfer to the condenser via different paths.

14. The heat transferring system of claim 13, wherein the plurality of the evaporators are not it direct contact with any target device that requires heat transfer.

15. The heat transferring system of claim 13, wherein the working fluid changes phase from a liquid to a vapor in at least one of the plurality of evaporators and changes phase from a vapor to a liquid in the condenser.

16. The heat transferring system of claim 13, wherein said at least one MEMS based check valve includes a pair of MEMS based check valves configured for controlling and regulating the flow of the working fluid into and out of the expandable MEMS device, respectively.

17. The heat transferring system of claim 13, wherein flexible tubing are utilized for coupling at least one of the plurality of evaporators, the condenser, the expandable MEMS device, and the at least one MEMS based check valve.

18. The heat transferring system of claim 13 in which parts or the entire heat transferring system is incorporated into one or more integrated circuit chips.

* * * * *